United States Patent [19]

Akamatsu

[11] Patent Number: 4,580,427

[45] Date of Patent: Apr. 8, 1986

[54] METHOD FOR MANUFACTURING ORNAMENTED HEAD LUG PIPES

[75] Inventor: Tatemi Akamatsu, Osaka, Japan

[73] Assignee: Eisho Seisakusho Co., Ltd., Japan

[21] Appl. No.: 681,369

[22] Filed: Dec. 13, 1984

[51] Int. Cl.[4] ..... B21D 39/08

[52] U.S. Cl. ..... 72/62; 29/157 T; 72/58; 72/61

[58] Field of Search ..... 72/58–62; 29/421 R, 157 T

[56] References Cited

U.S. PATENT DOCUMENTS

| | | | |
|---|---|---|---|
| 2,952,070 | 9/1960 | Veatch | 29/157 T |
| 3,210,984 | 10/1965 | Arbogast | 29/157 T |
| 3,670,545 | 6/1972 | Kent | 29/157 T |
| 3,961,513 | 6/1976 | Stahly | 72/58 |
| 4,051,704 | 10/1977 | Kimura | 72/61 |

*Primary Examiner*—Leon Gilden

*Attorney, Agent, or Firm*—Wegner & Bretschneider

[57] ABSTRACT

A method for manufacturing ornamented head lug pipes comprising a first stage for lug-forming and ornamenting and a second stage for finishing ornaments, wherein:

in the first stage, a bulge-forming rubber body is inserted into a tubular steel blank of required length having an outer diameter identical to the diameter of the finished said blank is placed in a die including therein a lug-forming cavitied section and a stepped section for applying pressure to the middle periphery thereof, and bulge-forming is effected under pressure to form a lug by bulging of the rubber body and form ornaments are formed on both ends of the blank there by reducing the diameter of said middle periphery, and in the second stage, the product from the first stage is fixedly placed in a die compressing a concave section for engagement with said lug, a concave section for engagement with said ornaments equal in diameter to the outer diameter of said blank and a concave section for engagement with the middle periphery of said blank, and a mandrel is inserted into said product from both its ends, said mandrel having a diameter slightly smaller than the inner diameter of said blank, whereby the contour of said ornaments is corrected to have the same outer diameter as that of the said blank for finishing.

1 Claim, 11 Drawing Figures

METHOD FOR MANUFACTURING ORNAMENTED HEAD LUG PIPES

FIELD OF THE INVENTION

The present invention relates to a method for manufacturing an ornamented head lug pipe for bicycles.

Background of the Invention

Conventionally, the head pipe adapted to be connected to the upper or lower pipe of a bicycle frame is fixedly provided with a lug which is formed separately from the head pipe per se. Recently, however, owing to reductions in the weight and cost the lug is formed integrally on the head pipe per se by bulging, and is provided therearound with a cut wave pattern for ornamentation.

One conventional method for manufacturing such ornamented head lug pipes comprises a first stage for forming a lug and a second stage for forming an ornamental pattern, as disclosed in U.S. Pat. No. 4,051,704. In the first stage, a tubular steel blank is inserted into a first die including therein a lug-forming cavity, said blank having an outer diameter substantially equal to the outer periphery of the middle portion of the finished product, except the oramented portions on both its sides, and a lug is formed by a hydraulic bulging-process with a high-pressure working oil filled in the blank. In the second stage, the blank is inserted into a second die including therein a cavity for ornamentation, and a mandrel is fitted into the blank from both its sides, said mandrel having an outer diameter larger than the inner diameter of the blank, whereby, in the second die for ornamentation, the blank is allowed to bulge on both its sides rather than at the middle portion to form an ornamental portion that is larger than the outer diameter of the blank.

In the prior art method as referred-to above, the first stage for lugforming and ornamentation relies upon the hydraulic type bulging process, which should be carried out with various sealing means in mind, since the use of a high-pressure working oil may possibly lead to an undesirable oil leakage problem. The second stage for ornamentation is designed to form at once ornamental portions by fitting into the blank a mandrel having an outer diameter larger than the inner diameter thereof for bulging. However, this second stage offers problems that a very large force is required, resulting in increases in the size of the arrangement applied, since it is required to bulge the blank in the radial direction normal to the direction of movement of the mandrel.

SUMMARY OF THE INVENTION

The present invention aims at resolving the problems presented by the prior art method for manufacturing ornamented head lug pipes. More specifically, a main object of the present invention is to provide a novel method for manufacturing ornamented head lug pipes, which makes use of relatively simple and small-sized means and thereby dispenses with any sealing means during the bulging process for lug-forming without an oil leakage problem at all, and which can form well-contoured ornamental portions with a relatively small force.

According to the present invention, this object is achieved by the provision of a method for manufacturing ornamented head lug pipes comprising a first stage for lugforming and ornamenting and a second stage for finishing ornaments, wherein:

in the first stage, a bulge-forming rubber body is inserted into a tubular steel blank of required length having an outer diameter identical to the diameter of the finished ornament said blank is placed in a die comprising a lug-forming cavitied section and a stepped section for applying pressure to the middle periphery thereof, and bulge-forming is effected under pressure to form a lug by bulging of the rubber body and ornaments are formed on both ends thereof by reducing the diameter of said middle periphery, and in the second stage, the product from the first stage is fixedly placed in a die comprising a concave section for engagement with said lug, a concave section for engagement with said ornaments equal in diameter to the outer diameter of said blank and a concave section for engagement with the middle periphery of said blank, and a mandrel is inserted into said product from both its ends, said mandrel having a diameter slightly smaller than the inner diameter of said blank, whereby the contour of said ornaments is corrected to have the same outer diameter as that of the said blank for finishing.

BRIEF DESCRIPTION OF THE DRAWINGS

The foregoing and other objects and features of the present invention will become apparent from the following detailed description with reference to the accompanying drawings, which are given for the illustration alone, and in which.

DETAILED EXPLANATION OF THE INVENTION

Figure 2:
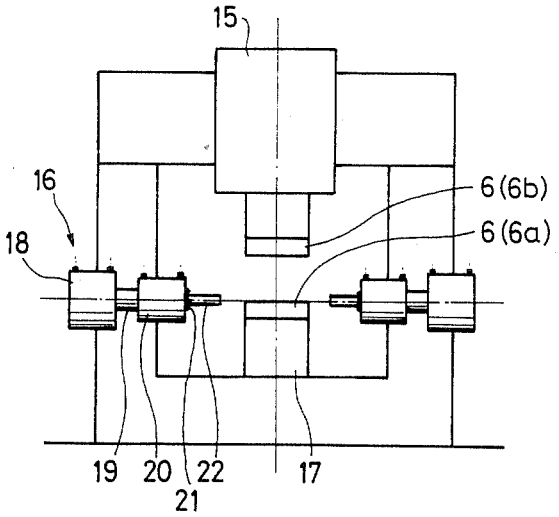
FIG. 2 is a generally front view of the arrangement used for carrying out the present invention.

The arrangement for carrying out the process according to the present invention will now be explained with reference to the FIGS. 2 to 5. Referring generally to FIG. 2, a vertically movable hydraulic cylinder 15 is provided on both its lower sides with horizontally movable hydraulic cylinders 16. An upper die is mounted on the lower portion of the hydraulic cylinder 15, and a lower die is fixedly placed on a lower framework 17.

Figure 5:
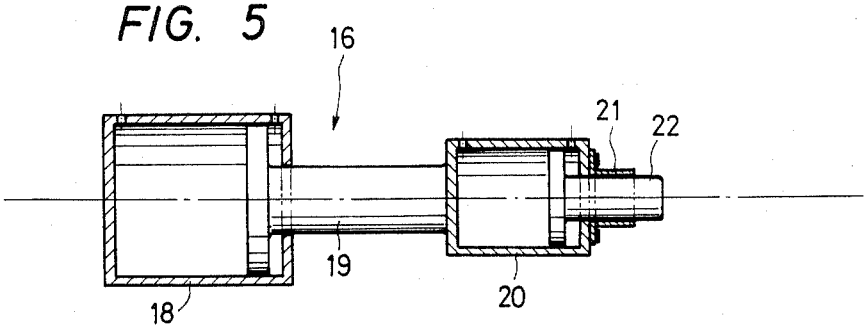
FIG. 5 is a longitudinally sectioned plan view of the lefthand horizontally movable hydraulic cylinder.
Figure 6:
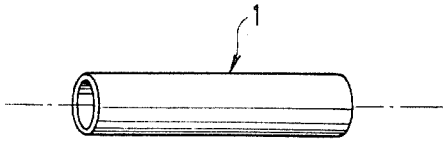
FIG. 6 is a perspective view of the tubular steel blank.

As illustrated in FIG. 5, each of the horizontally movable hydraulic cylinders 16 is of the series dual type wherein a first rear cylinder section 18 has a piston rod 19 which is provided at its front portion with a second cylinder section 20. The second cylinder section 20 is detachably provided at its front portion with an engaging short cylindrical member 21 with the use of a flange, said member having inner and outer diameters substantially equal to those of the tubular blank 1. The second cylinder section 20 includes a piston rod 22 capable of projecting forwardly through the member 21.

Figure 3:
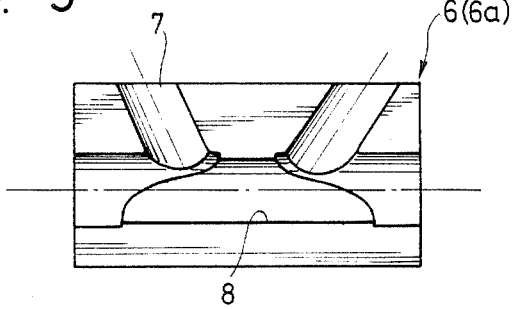
FIG. 3 is a cross-sectional plan view of the lower die used in the first stage.

FIG. 3 is a cross-sectional plan view of the lower die 6*a* for lug-forming and ornamenting, which is applied in the first stage. As illustrated, the lower die includes cavitied sections 7 for forming the upper and lower lugs, and a projecting stepped portion 8 for ornamenting, which is designed to reduce the outer diameter of the middle portion 3 of the blank 1, while keeping both side portions thereof intact. The upper die 6*b* is symmetric in shape with respect to the lower die 6*a*.

Figure 4:
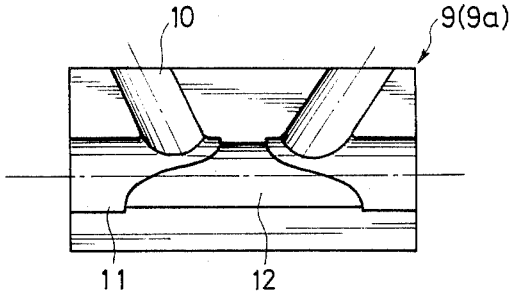
FIG. 4 is a cross-sectional plan view of the lower die used in the second die.

FIG. 4 is a cross-sectional plan view showing a lower die 9*a* which is used to finish the ornamented portions in the second stage. The lower die 9*a* includes cavitied sections 10 for fitting therein the lugs 4 formed in the first stage, a section 12 for receiving therein the diametrically reduced middle portion 3 of the blank 1, and a section 11 for receiving therein the ornamented portions, which has a diameter equal to the outer diameter of the blank 1. The corresponding upper die (not shown) is symmetric in shape with respect to the lower die 9*a*. The lower (9*a*) and the upper (9*b*) dies can be mounted in place after the removal of the aforesaid upper and lower dies 6*b* and 6*a* for lug-forming and ornamenting.

A mandrel 13 used to finish the ornamented portions has an outer diameter slightly smaller than the inner diameter of the blank 1 with one end being slightly smaller in diameter than the other end, and can be mounted to the front portion of the second cylinder section 20 after the removal of the short cylindrical member 21 for bulge-forming. It is noted that reference numerals 23 and 24 stand for upper and lower pipes, respectively.

In the foregoing arrangement, the cylinders 15 and 16 operate in the following order. In the first stage for lug-forming and ornamenting, the piston rod of the vertical cylinder 15 first moved down and applied pressure to the blank 1. Subsequently, the first and second cylinder sections 18 and 20 of the horizontal cylinders 16 operate and apply pressure on both sides of the blank 1. In the second stage for finishing the ornamented portions, the vertical cylinder 15 operates and, thereafter, only the first cylinder section 18 is designed to operate, while the second cylinder section 20 is not at work.

Figure 1:
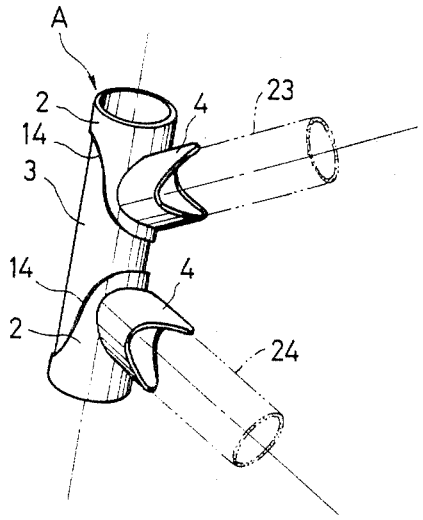
FIG. 1 is a perspective view of the finished ornamented head lug pipe.

The process according to the present invention is carried out in the following order. The tubular steel blank, as shown in FIG. 1, is prepared, which, for instance, has an outer diameter of 34 mm, an inner diameter of 30 mm and a length longer than that of the finished product by 50 to 60 mm. It is noted that the outer diameter of the blank 1 should be equal to those of the ornamented portions 2. Thus, this should be taken into account when determining the thickness of the blank 1.

Figure 7:
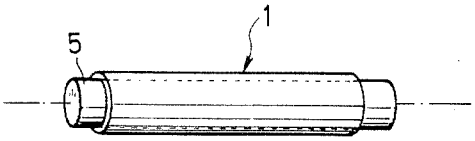
FIG. 7 is a perspective view of the blank into which the rubber body is inserted.
Figure 8:
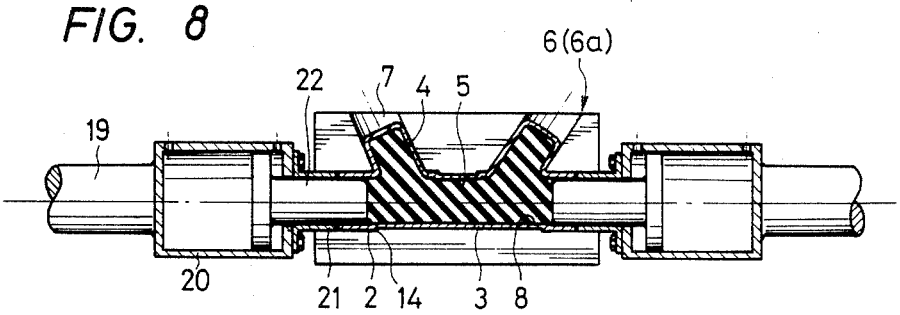
FIG. 8 is a cross-sectional front view showing the first stage.

In the first stage for lug-forming and ornamenting, a rubber body 5 for bulge-forming is inserted into the tubular steel blank 1, as illustrated in FIG. 7, and is placed in the lower die 6*a*. Then, the cylinders 15 and 16 are allowed to operate. In this case, the blank 1 is first clamped and pressed between the upper and lower dies 6*b* and 6*a* by the vertically movable hydraulic cylinder. Upon subsequent advancement of the first cylinder section 18 of the horizontal cylinders 16, as shown in FIG. 8, the short cylindrical member 21 on the front portions of the second cylinder section 20 enters the upper and lower dies 6*b* and 6*a* thereby to press the tubular blank 1 from both its sides. Almost simultaneously, the piston rod 22 advances from the second cylinder section 20 through the short cylindrical member 21, and applies pressure to both sides of the bulge-forming rubber body 5.

Figure 9:
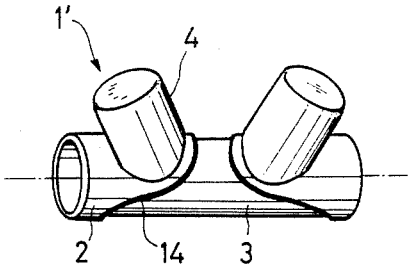
FIG. 9 is a perspective view of the pre-product processed in the first stage.
Figure 10:
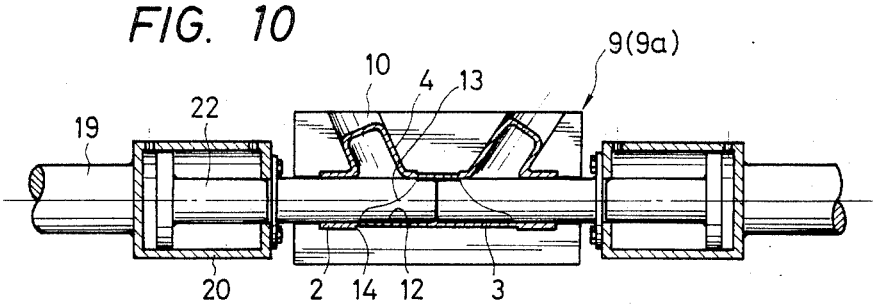
FIG. 10 is a cross-sectional front view of the pre-product which is being processed in the second stage.

As a result, the tubular blank 1 bulges on both its sides corresponding to the cavitied sections in the upper and lower dies 6*b* and 6*a* to form the lugs 4, as illustrated in FIG. 9. At the same time, the periphery 3 of the middle portion of the blank 1 is reduced in diameter by the ornamenting stepped portions 8 of the upper and lower dies 6*b* and 6*a*, while keeping both side portions thereof intact, and leaving them as the cut wave-like ornamented portions 2. In this case, the ornaments 2 are in the substantially perfect form. In some cases, however, the contours 14 of the ornaments 2 may incline slightly or reduce excessively in diameter. To this end, the second finishing stage is designed.

In the next stage for fishing, the lower and upper dies 6*b* and 6*a* are removed to set the finishing lower (9*a*) and upper dies in place, and the short cylindrical member 21 is removed from the front portion of the second cylinder section 20 to mount the mandrel 13 in place, while the supply of pressurized oil to the second cylinder section 20 is interrupted. In this state, the pre-product 1′ processed at the first stage is engaged within the sections 10, 11 and 12 in the lower die 6*a*, and the upper die is lifted down to fix the pre-product 1′ in place. Then, the piston rod 19 of the first cylinder section 18 of the horizontal cylinder 16 advances, so that the mandrel 13, having a diameter virtually equal to the original inner diameter of the blank 1, is inserted into the pre-product 1′ from both its sides, thereby to correct the inclined or excessively reduced portions of the contour 14 of the ornament 2. More specifically, while the ornament 2 is fitted in the section 11, it receives inward force over the region extending from the end to the contour 14, and is restored to the same diameter (34 mm) as that of the original blank 1. The middle periphery 3 of the blank 1 is corrected along the concaved section 12. In consequence, the contour 14 of the ornament 2 includes a prominently sharp angular portion.

Figure 11:
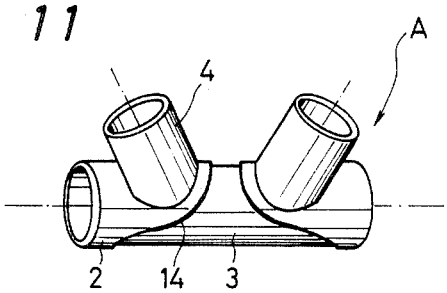
FIG. 11 is a perspective view illustrating the ornamented head lug pipe finished in the second stage.

In the ornamented head lug pip A thus formed, the ornament 2 has a 34 mm outer diameter that is idential with that of the blank 1, and the reduced middle periphery 3 is about 32 mm in the outer diameter and about 28 mm in the inner diameter. Thereafter, the end of each lug 4 is opened by cutting, as illustrated in FIGS. 11 and 1.

According to the present invention, the bulge-processing for lugforming can be carried out by relatively small means with no fear of oil leakage at all, and any sealing means is dispensed with. That is, the conventional bulge-processing for lug-forming was of the hydraulic type wherein a high-pressure working oil was used, thus posing an oil leakage problem and a problem arose of how sealing means was employed. Since the present invention makes use of the rubber body for which no pressurized oil is used, to the contrary, there is no fear that an oil may leak,with no need of using any sealing means. In addition, the arrangement is reduced in overall size and simplified in structure, since any attachment required for a high-pressure working oil is dispensed with.

The force for inserting the mandrel for finishing is so small that it is possible to reduce the size of the arrangement. According to the prior art, the second stage was exclusively designed for forming ornaments, and, to this end, the steel blank was allowed to bulge at once by the insertion of the mandrel under pressure in the radial direction normal to the movement thereof. For that reason, the insertion of the mandrel required a large force, resulting in an increase in the size of the arrangement. However, according to the present invention, the lugs and ornaments are formed in the first stage and the ornaments are finished in the second stage. The reason for inserting the mandrel into the tubular blank to finish the ornaments in the second stage is, therefore, that the portion, which is slightly inwardly pressed in the first stage, is restored to the virtually same outer diameter as that of the tubular blank 1. Accordingly, the force is for inserting the mandrel is smaller than the conventionally required force with the resulting reduction in the size.

In addition, since the ornaments are formed in the first stage and finished in the second stage as mentioned above, the ornaments including a sharp angle can be well-defined, even if they are of a complicated shape.

What is claimed is:

1. A method for manufacturing ornamented head lug pipes comprising a first stage for lug-forming and ornamenting and a second stage for finishing ornaments, wherein:

in the first stage, a bulge-forming rubber body is inserted into a tubular steel blank of required length having an outer diameter identical to the diameter of the finished ornament, said blank is placed in a die comprising a lug-forming cavitied section and a stepped section for applying pressure to the middle periphery thereof, whereby bulge-forming is effected under pressure to form a lug by bulging of the rubber body and ornaments are formed on both ends of the blank by reducing the diameter of said middle periphery, and in the second stage, the product from the first stage is fixedly placed in a die comprising a concave section for engagement with said lug, a concave section for engagement with said ornaments equal in the diameter to the outer diameter of said blank and a concave section for engagement with the middle periphery of said blank, and a mandrel is inserted into said product from both its ends, said mandrel having a diameter slightly smaller than the inner diameter of said blank, whereby the contour of said ornaments is corrected to have the same outer diameter as that of the said blank for finishing.

* * * * *